US007614394B2

(12) United States Patent
Li

(10) Patent No.: US 7,614,394 B2
(45) Date of Patent: Nov. 10, 2009

(54) PNEUMATIC TOY GUN AND AIR VALVE THEREOF

(76) Inventor: Jin-Fong Li, No. 2-3, Lane 82, Long Cyuan St., Banciao City, Taipei County (TW)

( * ) Notice: Subject to any disclaimer, the term of this patent is extended or adjusted under 35 U.S.C. 154(b) by 25 days.

(21) Appl. No.: 11/952,166

(22) Filed: Dec. 7, 2007

(65) Prior Publication Data

US 2009/0145413 A1 Jun. 11, 2009

(51) Int. Cl.
*F41B 11/00* (2006.01)

(52) U.S. Cl. ..... 124/73; 124/70

(58) Field of Classification Search ..... None
See application file for complete search history.

(56) References Cited

U.S. PATENT DOCUMENTS

| | | | | |
|---|---|---|---|---|
| 5,613,483 | A * | 3/1997 | Lukas et al. | 124/73 |
| 6,925,997 | B2 * | 8/2005 | Sheng | 124/74 |
| 7,237,544 | B2 * | 7/2007 | Jones | 124/73 |
| 2005/0005924 | A1 * | 1/2005 | Sheng | 124/74 |
| 2006/0037597 | A1 * | 2/2006 | Wood | 124/73 |
| 2006/0107939 | A1 * | 5/2006 | Dobbins | 124/73 |
| 2006/0162714 | A1 * | 7/2006 | Lai | 124/74 |
| 2006/0207586 | A1 * | 9/2006 | Jones | 124/74 |
| 2007/0209650 | A1 * | 9/2007 | Jones | 124/73 |
| 2007/0215133 | A1 * | 9/2007 | Jones | 124/73 |
| 2007/0267005 | A1 * | 11/2007 | Yeh | 124/74 |
| 2008/0099005 | A1 * | 5/2008 | Kaakkola et al. | 124/74 |

* cited by examiner

*Primary Examiner*—Michael Carone
*Assistant Examiner*—Samir Abdosh
(74) *Attorney, Agent, or Firm*—Troxell Law Office, PLLC

(57) ABSTRACT

A pneumatic toy gun includes a pneumatic assembly and an air valve. The pneumatic assembly has an air intake duct to receive high pressure gas and includes a first duct, a rear push rod, a front push rod and a harness element. A first gas chamber is formed between the rear push rod and the first duct. A second gas chamber is formed between the front push rod and the first duct. The second gas chamber has a second thrust surface smaller than a first thrust surface of the first gas chamber. The front push rod has a recess. When the front push rod is moved and the recess is located beneath the first sealing element, the second gas chamber communicates with an air outlet through the recess. The pneumatic toy gun of the invention can provide a strong instantaneous blast force without increasing battery voltage.

6 Claims, 8 Drawing Sheets

PNEUMATIC TOY GUN AND AIR VALVE THEREOF

BACKGROUND OF THE INVENTION

1. Field of the Invention

The present invention relates to a toy gun and particularly to a pneumatic toy gun.

2. Description of the Prior Art

These days many people are very busy in their work. Leisure activities become very important for people to unwind and recharge so that they can face more challenges in the work. Leisure activities are very diversified, and many choices are available to suit individual's tastes and preferences. For instance, outdoor excursion, seeing movies, shopping and the like can help people to reduce tension. Some people prefer more exciting activities to release the internal pressure, such as thrilling games in theme parks, glider riding, bungee jumping or the like. In recent years a new type of game has been introduced, namely "Survival game". In the game players have to equip with comprehensive outfits to prevent accidents. Each person also is provided with a pneumatic toy gun and a plurality of paintballs. The paintball is a capsule containing pigments. This game is quite popular, not only because it is exciting, but also mainly the toy gun used in the game almost like a real one in terms of shooting accuracy, shooting range, look and weight. Hence it gives people thrill like being plunged in a real battlefield.

However, the pneumatic toy guns now available on the market have a rather small air valve capacity. It does not have a sufficient instantaneous gas pressure blast force to eject paintballs. To increase airflow of the air valve and activate a larger valve require a mating voltage of batteries and the housing space of the batteries has to be increased. Then the weight and size of the paintball weapon also increase. These are the drawbacks of the conventional paintball weapon.

Hence how to provide greater instantaneous gas pressure blast force without increasing battery voltage is an issue remained to be resolved in the industry.

SUMMARY OF THE INVENTION

Therefore the primary object of the invention is to provide a pneumatic toy gun that has a greater instantaneous gas pressure blast force without increasing battery voltage.

To achieve the foregoing object, the pneumatic toy gun of the invention includes a pneumatic assembly and an air valve. The pneumatic assembly has an air intake duct to receive high pressure gas, and also includes a first duct, a rear push rod, a front push rod and a harness element. The first duct has an open end and an air outlet communicating with exterior. It also has a detent block located inside. The rear push rod is located in the first duct. Between the rear push rod and the first duct a first gas chamber is formed. The first gas chamber has a first thrust surface. The air valve controls the communication of the first gas chamber and the air intake duct. The front push rod is located in front of the rear push rod, and is coupled with a first sealing element on the periphery. The front push rod has a recess and an air discharge passage communicating with the open end of the first duct. The air discharge passage has a rear end sealed by the rear push rod. The first duct and the front push rod form a second gas chamber between them. The second gas chamber communicates with the air intake duct. The second gas chamber has a second thrust surface which has a smaller area than the first thrust surface. The harness element confines two sides of the first sealing element. The first push rod can be moved relative to the first sealing element to make the recess beneath the first sealing element, then the second gas chamber and the air outlet communicate with each other through the recess, then an instantaneous press loss is generated, and the detent block and the rear push rod interfere with each other.

The invention also provides an air valve which includes a valve body, a first valve disc and a valve stem. The valve body has a first connection port, a second connection port and a first slide flute. The first connection port communicates with the air intake duct. The valve body also has a first valve seat located inside. When the first valve disc is in contact with the first valve seat, the first connection port does not communicate with the second connection port. The first valve disc has a rear end extended to form a second duct which has a tail end on which a first slide element is placed. The first slide element can slide on the first slide flute. The first slide element is coupled with a second sealing element on the periphery thereof. The first slide flute has a third gas chamber and a fourth gas chamber that are spaced by the first slide element. The valve stem runs through the second duct and has a tail end exposed outside the valve body. The valve stem has an outer diameter smaller than the inner diameter of the second duct, and a head with an outer diameter greater than the inner diameter of the second duct to press the first valve disc. The valve stem can be moved forwards so that its head is separated from the first valve disc, then high pressure gas flown through the first connection port can flow into the third gas chamber through the second duct.

By means of the construction of the pneumatic assembly set forth above, after the front push rod and rear push rod are separated, the high pressure gas in the first gas chamber flows instantaneously into the air discharge passage, hence a greater instantaneous gas pressure blast force takes place to drive bullets. In the air valve of the invention the push elements have to push only the valve stem of a smaller mass quantity to trigger the high pressure gas to push the first valve disc of a greater cross section forwards. Thus the pneumatic gun of the invention can provide an instantaneous gas pressure blast force without the need of increasing the battery voltage.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
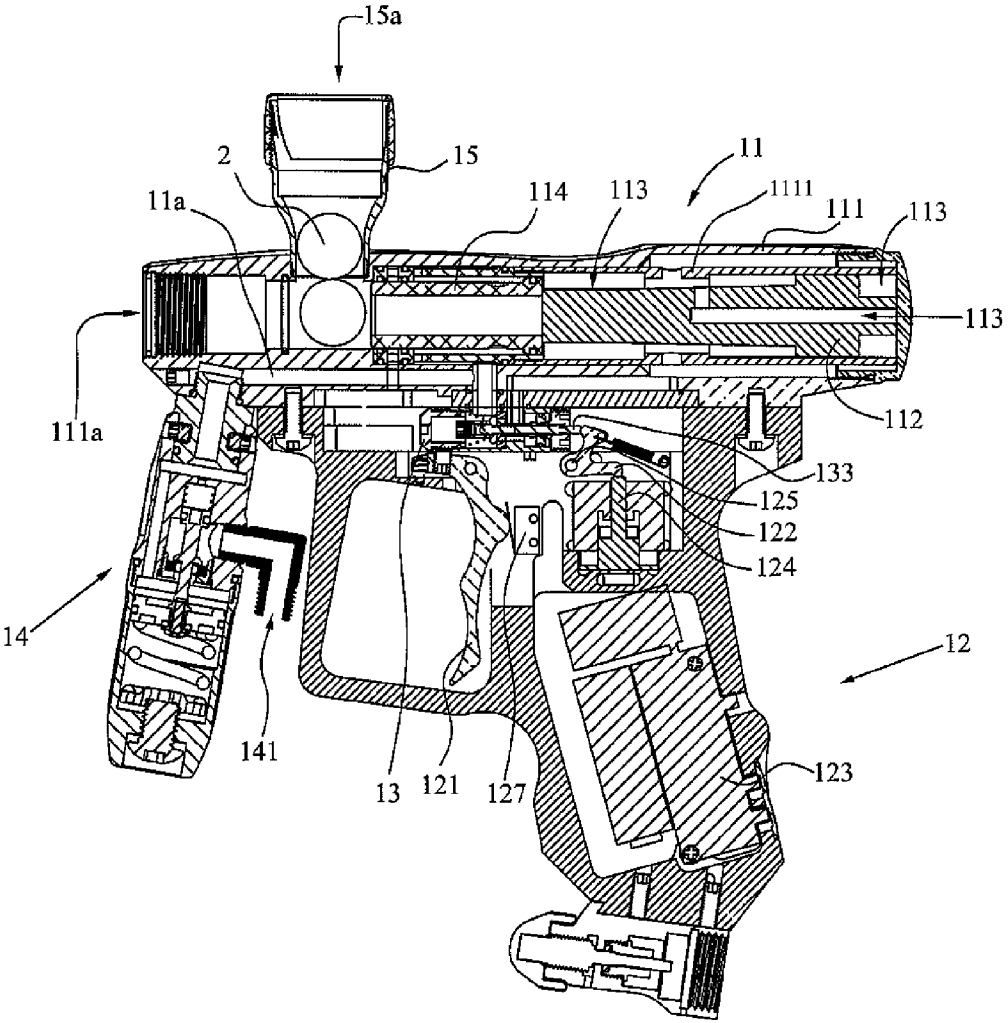
FIG. 1 is a sectional view of a first embodiment of the pneumatic gun of the invention.
Figure 2A:
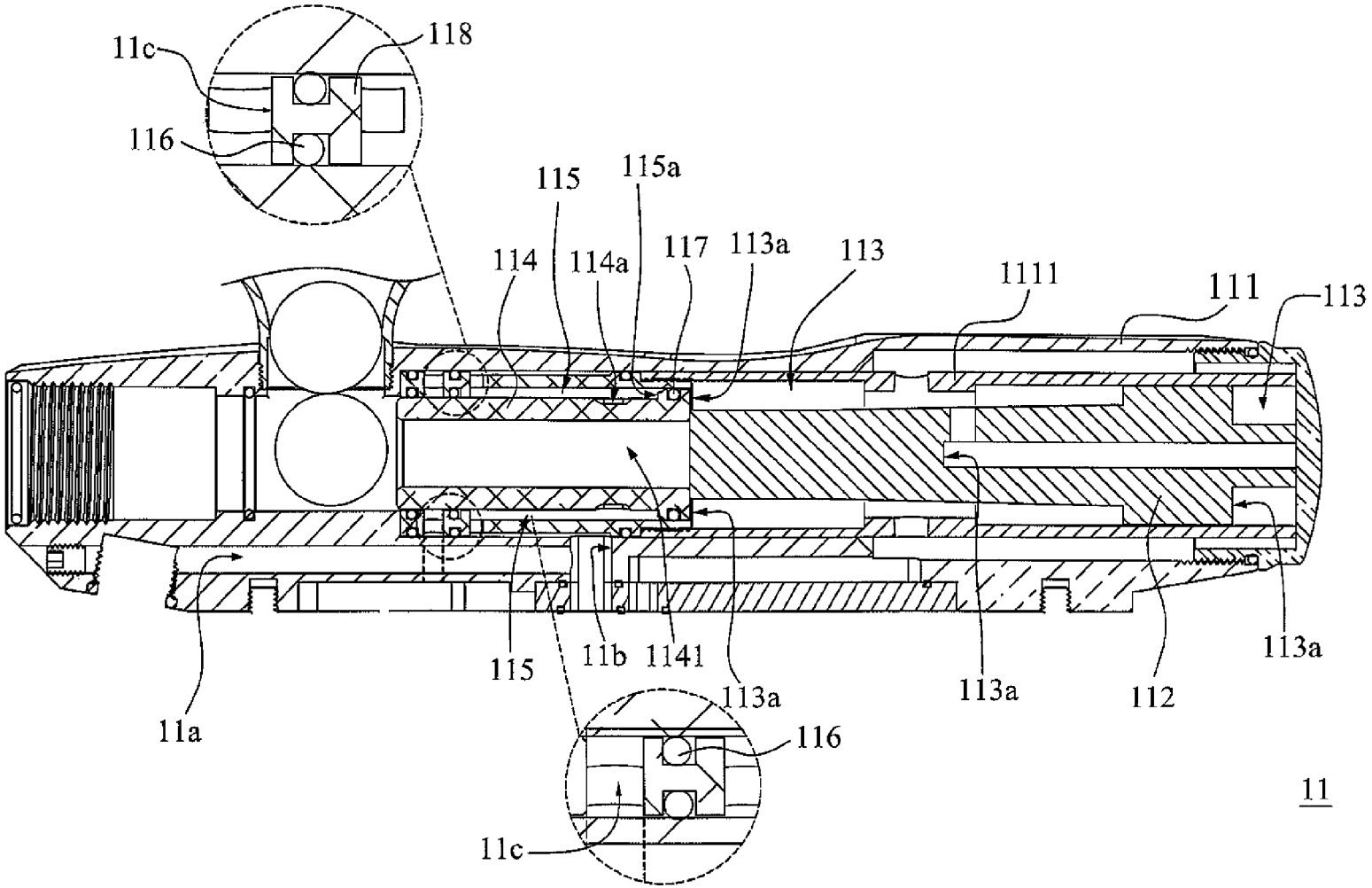
FIGS. 2A, 2B and 2C are sectional views of the pneumatic assembly in different conditions.

Please refer to FIGS. 1 and 2A for an embodiment of the pneumatic toy gun and a pneumatic assembly of the invention. The pneumatic toy gun 1 includes a pneumatic assembly 11, a hand stock 12, an air valve 13, an air pressure regulation means 14 and a bullet loading means 15. The pneumatic assembly 11 includes a first duct 111, a rear push rod 112, a front push rod 114 and a harness element 118. The first duct 111 has an open end 111*a* at a front end communicating with the exterior and a detent block 1111 located inside. The rear push rod 112 is located in the first duct 111 behind the front push rod 114. The front push rod 114 further has a recess

114*a*. The rear push rod 112 and the first duct 111 are interposed by a plurality of first gas chambers 113 which communicate with one another. The first gas chambers 113 have a first thrust surface 113*a* which is the pressure applying surface when the gas pressure of the first gas chamber 113 exerting on the front push rod 114 and rear push rod 112. The applying force is in the transverse direction, namely the axial direction of the first duct 111. In other words, the first thrust surface 113*a*, aside from serving as a contact surface of the front push rod 114 and the first gas chamber 113, also serves as a contact surface of the rear push rod 112 and the first gas chamber 113.

The front push rod 114 and the first duct 111 are interposed by a second gas chamber 115 which communicates with an air intake duct 11*a* through a first connection duct 11*b*. The second gas chamber 115 has a second thrust surface 115*a* formed at an area smaller than the first thrust surface 113*a* of the first gas chamber 113. The second thrust surface 115*a* is a pressure applying surface of the gas pressure of the second gas chamber 115 exerting on the front push rod 114. The force is applied transversely. In addition, the first duct 111 has an air outlet 11*c* communicating with the exterior. The front push rod 114 has a front end coupling with a first sealing element 116 on the periphery thereof. The first sealing element 116 is an O-shape ring to isolate the second gas chamber 115 from the air outlet 11*c*. The front push rod 114 further has a rear end coupling with a fourth sealing element 117 on the periphery to isolate the second gas chamber 115 and the first gas chamber 113. The front push rod 114 also has an air discharge passage 1141 which has a front end communicating with the open end 111*a* of the first duct 111. The air discharge passage 1141 has a rear end sealed by the rear push rod 112.

The harness element 118 is located above the front push rod 114 and formed at a cross section of a H-shape to confine two sides of the first sealing element 116. Hence when the front push rod 114 is moved transversely, the first sealing element 116 remains at the original location.

The bullet loading means 15 is located above the first duct 111, and has a bullet loading port 15*a* to receive and load a bullet 2 into the first duct 111. The bullet 2 may be a paintball or other types of bullets, such as a rubber ball. The hand stock 12 is located beneath the pneumatic assembly 11. The air pressure regulation means 14 communicates with an air supply device (not shown in the drawings) through an air inlet 141. The air supply device may be a high pressure barrel. As it is usually has too high of gas pressure, and the pressure regulation means 14 is provided to regulate the gas pressure. The high pressure gas is output through the pressure regulation means 14 and enters the air intake duct 11*a*. In this embodiment the air intake duct 11*a* is located in the pneumatic assembly 11.

Figure 2B:
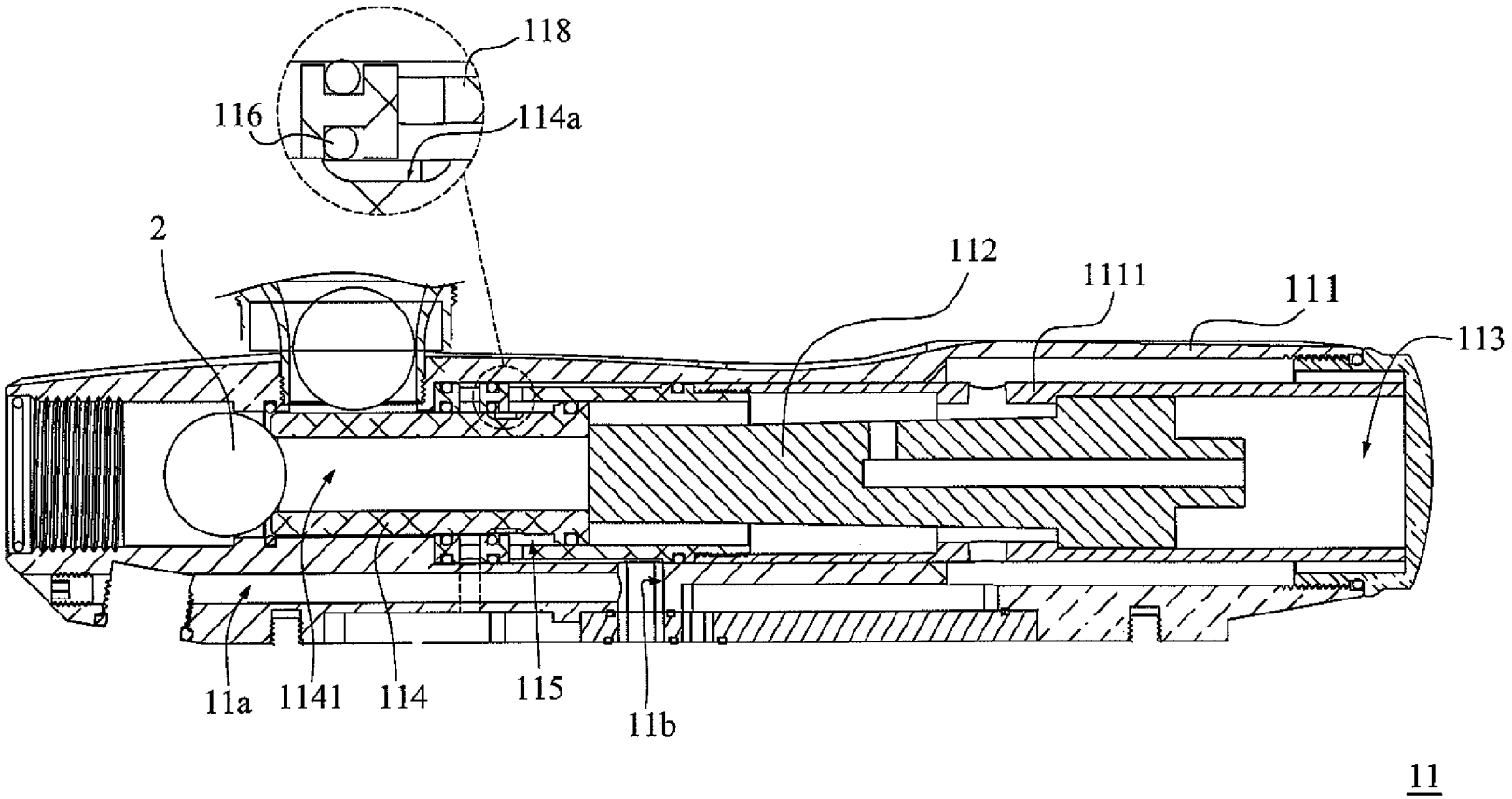
Figure 2C:
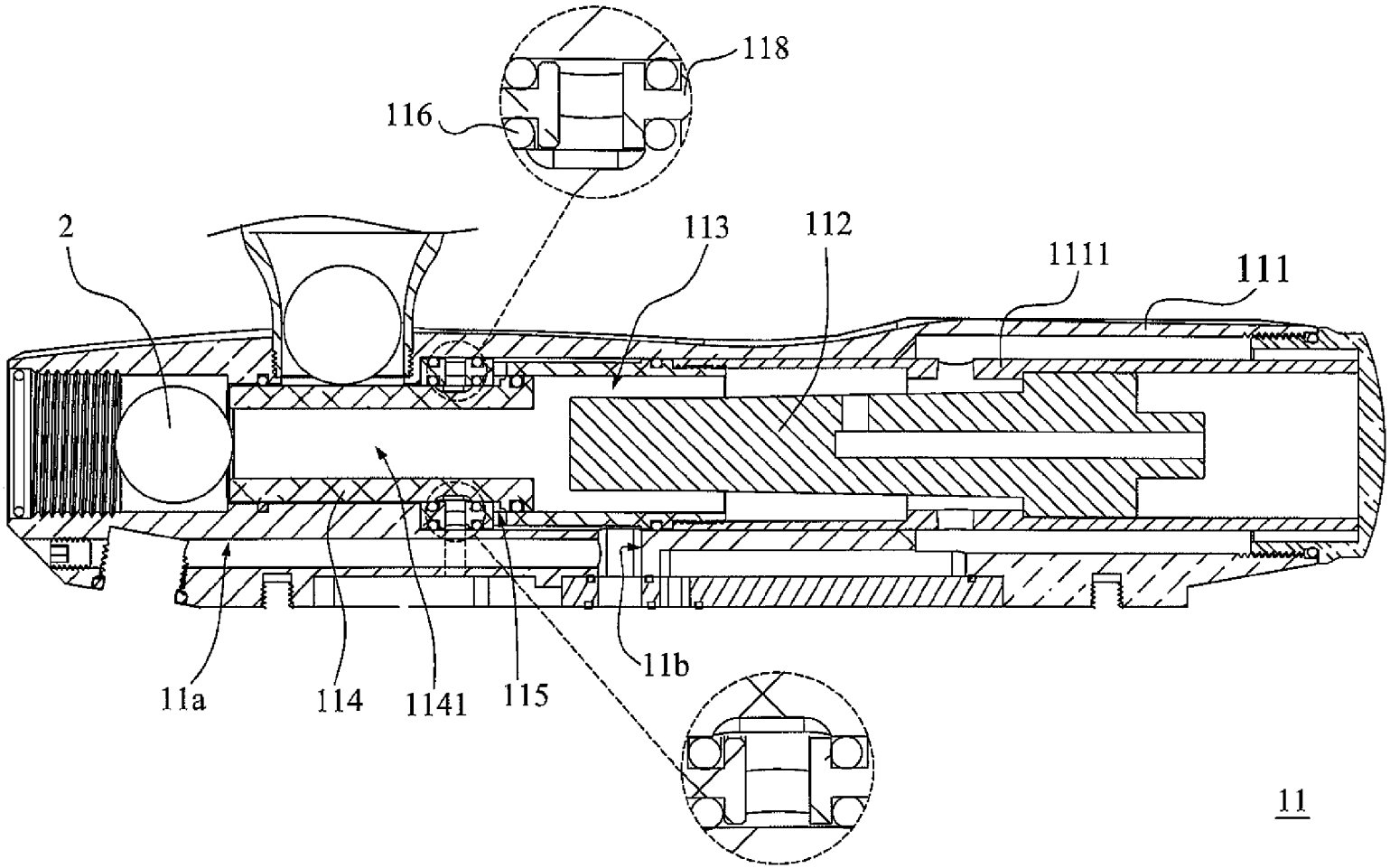

The air valve 13 aims to control communication between the first gas chamber 113 and the air intake duct 11*a* so that the high pressure gas can flow front the air intake duct 11*a* to the first gas chamber 113 through the air valve 13. Referring to FIG. 2B, when the air valve 13 is opened, as the first and second gas chambers 113 and 115 communicate with the air intake duct 11*a*, the pressure in the first gas chamber 113 and second gas chamber 115 is the same. But since the area of the first thrust surface 113*a* is greater than the second thrust surface 115*a*, the rear push rod 112 drives the front push rod 114 and the bullet 2 forwards. After the front push rod 114 has moved forwards for a selected distance, the recess 114*a* is located below the first sealing element 116 so that the second gas chamber 115 communicates with the air outlet 11*c*. Referring to FIG. 2C, hence the second gas chamber 115 generates an instant pressure loss phenomenon. Moreover, when the second gas chamber 115 communicates with the air outlet 11*c*, the detent block 1111 interferes with the rear push rod 112 so that the rear push rod 112 cannot be moved forwards continuously. As a result, the front push rod 114 and the rear push rod 112 are separated. And the high pressure gas in the first gas chamber 113 flows into the air discharge passage 1141 of the front push rod 14 and ejects the bullet 2.

After the front push rod 114 and the rear push rod 112 are separated, the high pressure gas of the first gas chamber 113 flows into the air discharge passage 1141 instantly, hence a greater pressure blast force is generated to drive the bullet 2.

After the bullet 2 has been ejected, the air valve 13 is closed, and the air intake duct 11*a* does not communicate with the first gas chamber 113. However, the high pressure gas still continuously flows into the second gas chamber 115. Thus a pressure difference is formed between the second gas chamber 115 and the first gas chamber 113 to push the front push rod 114 back to the location as shown in FIG. 2A.

Figure 3A:
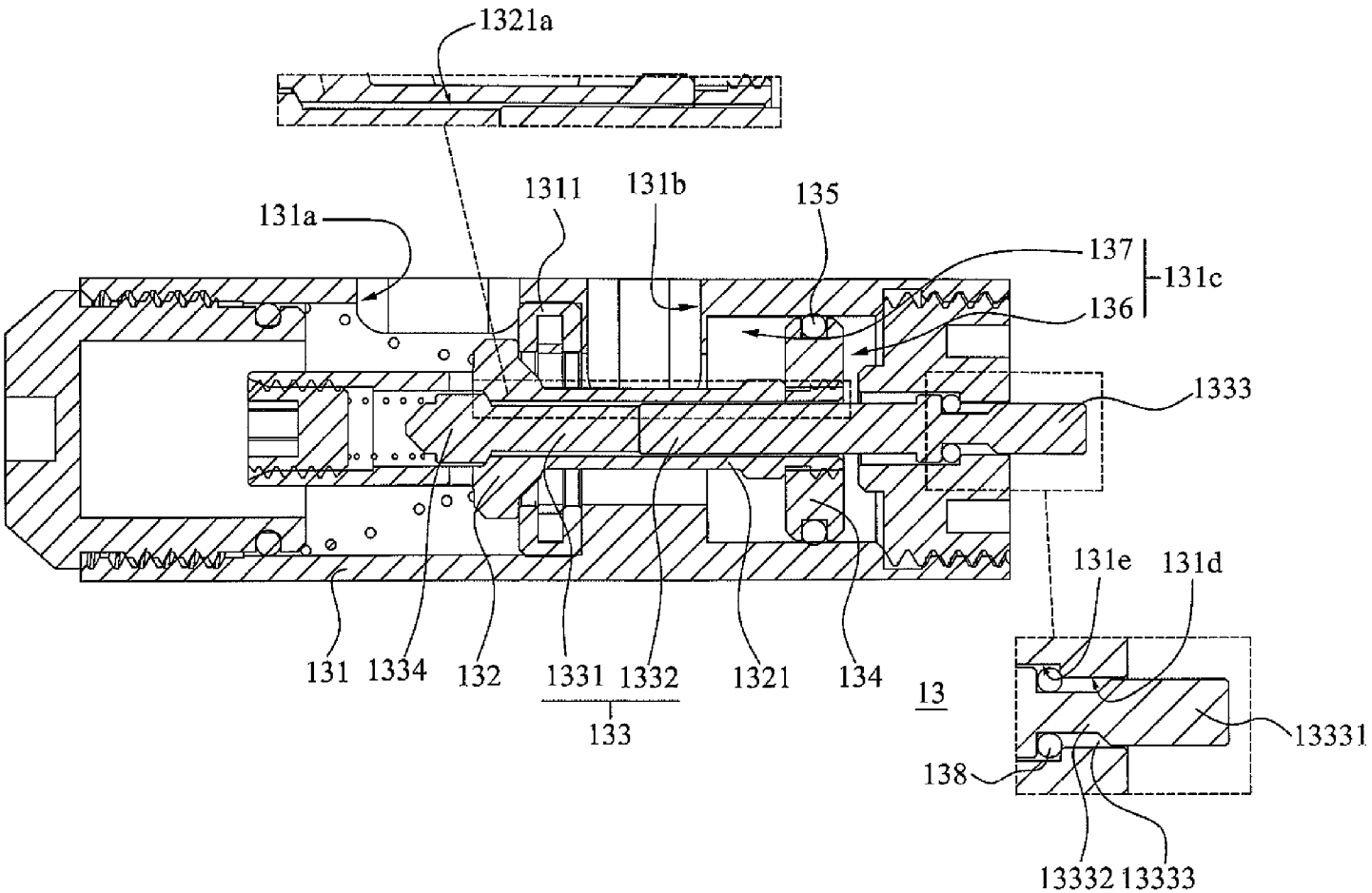
FIGS. 3A, 3B, 3C and 3D are sectional views of the air valve in different conditions.

Refer to FIG. 3A for the structure and operation principle of the air valve 13. The air valve 13 includes a valve body 131, a first valve disc 132 and a valve stem 133. The valve body 131 has a first connection port 131*a*, a second connection port 131*b* and a first slide flute 131*c* located therein. The first connection port 131*a* communicates with the air intake duct 11*a* of the pneumatic assembly 11. Hence the high pressure gas will flow into the valve body 131. The valve body 131 further has a first valve seat 1311. When the first valve disc 132 and the first valve seat 1311 are connected, the first connection port 131*a* and the second connection port 131*b* do not communicate with each other. The first valve disc 132 has a rear end extended to form a second duct 1321 which has a tail end with a first slide element 134 located thereon to slide on the first slide flute 131*c*. The first slide element 134 is coupled with a second sealing element 135 on the periphery that is an O-shape ring. The first slide flute 131*c* is divided by the first slide element 134 to form a third gas chamber 136 and a fourth gas chamber 137. The second sealing element 135 blocks airflow between the third gas chamber 136 and the fourth gas chamber 137.

The valve stem 133 runs through the second duct 1321 and has a tail end 1333 with a portion exposed outside the valve body 131. The valve stem 133 has an outer diameter smaller than the inner diameter of the second duct 1321. Hence a gas passage 1321*a* is formed between the valve stem 133 and the second duct 1321. Moreover, the valve stem 133 has a head 1334 formed at an outer diameter greater than the inner diameter of the second duct 1321 to press the first valve disc 132. Hence the high pressure gas flown in through the first connection port 131*a* does not pass through the gas passage 1321*a* to the third gas chamber 136. The valve stem 133 includes a front valve stem 1331 and a rear valve stem 1332. The head 1334 of the valve stem 133 is located on the front valve stem 1331. The tail end 1333 of the valve stem 133 is located on the rear valve stem 1332. Such a structure makes fabrication and assembly easier.

The valve body 131 fiber has a second slide flute 131*d* and a third slide flute 131*e* that communicate with each other. The second slide flute 131*d* has a smaller inner size than the third slide flute 131*e*. The tail end 1333 of the valve stem 133 has a larger shank 13331 and a smaller shank 13332. The larger shank 13331 is in contact with the second slide flute 131*d* by sliding. The larger shank 13331 and the smaller shank 13332 are connected through a conical surface 13333. The smaller shank 13332 is coupled with a third sealing element 138. The second slide flute 131*d* has one end close to the third gas chamber 136 and sealed by the third sealing element 138 to block gas flow between the third gas chamber 136 and the exterior.

Figure 3B:
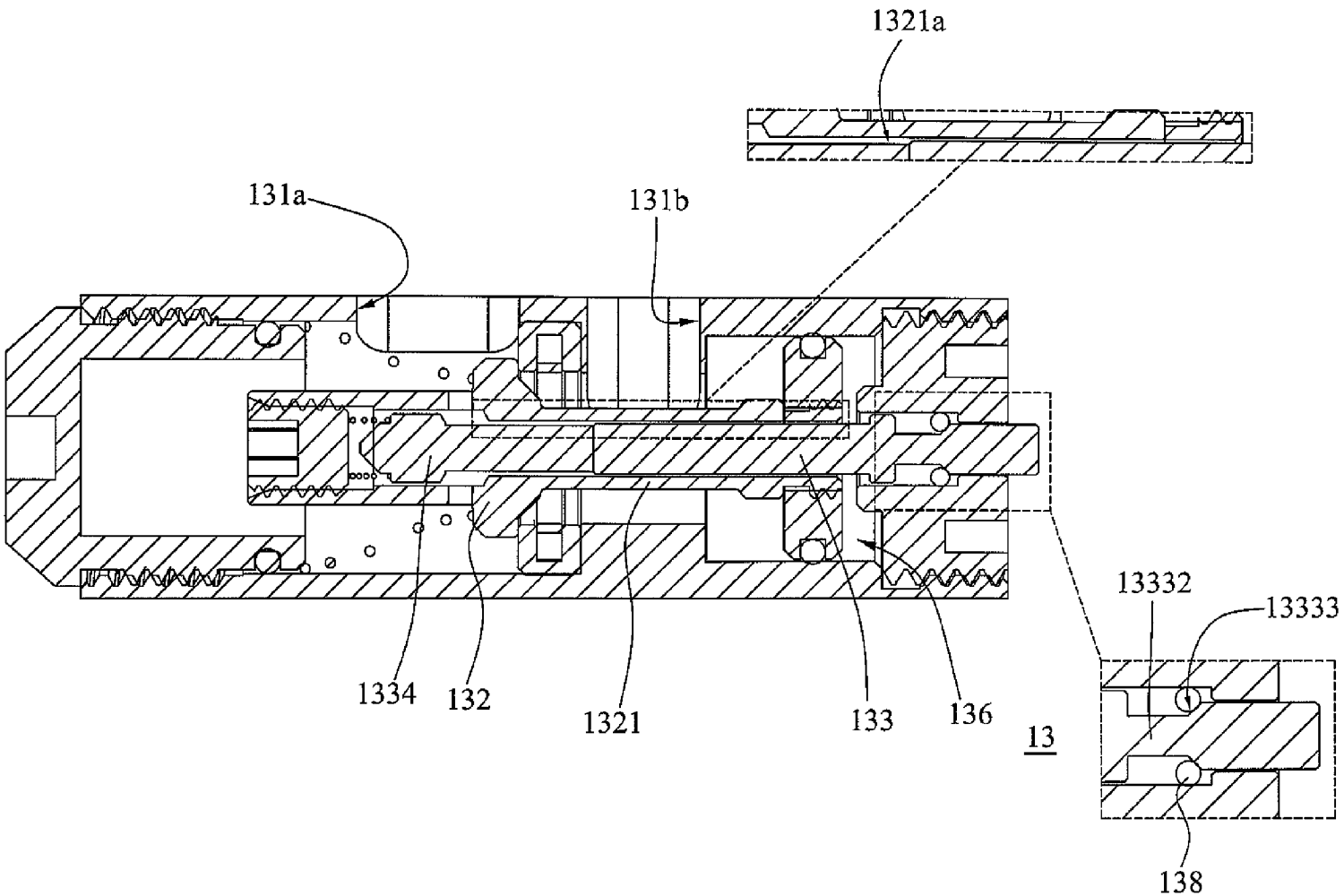

Referring to FIGS. 1 and 3B, the hand stock 12 has a trigger 121 and a thrust element 122, a power switch 127, a power supply 123 and an electromagnetic pushing rod 124 located inside. When the trigger 121 is depressed, the power switch 127 activates the power supply 123 to drive the electromagnetic pushing rod 124 upwards which in turn pushes the thrust element 122 to rotate about an axle 125. The thrust element 122 has one end pushes the tail end 1333 of the valve stem 133 to move forwards, and the head 1334 is separated from the first valve 132. The high pressure gas flown through the first connection port 131*a* flows through the gas passage 1321*a* of the second duct 1321 into the third gas chamber 136. When the valve stem 133 is pushed forwards, the third sealing element 138 originally located on the smaller shank 13332 is moved to the conical surface 13333 to block gas flow between the third gas chamber 136 and the exterior.

Figure 3C:
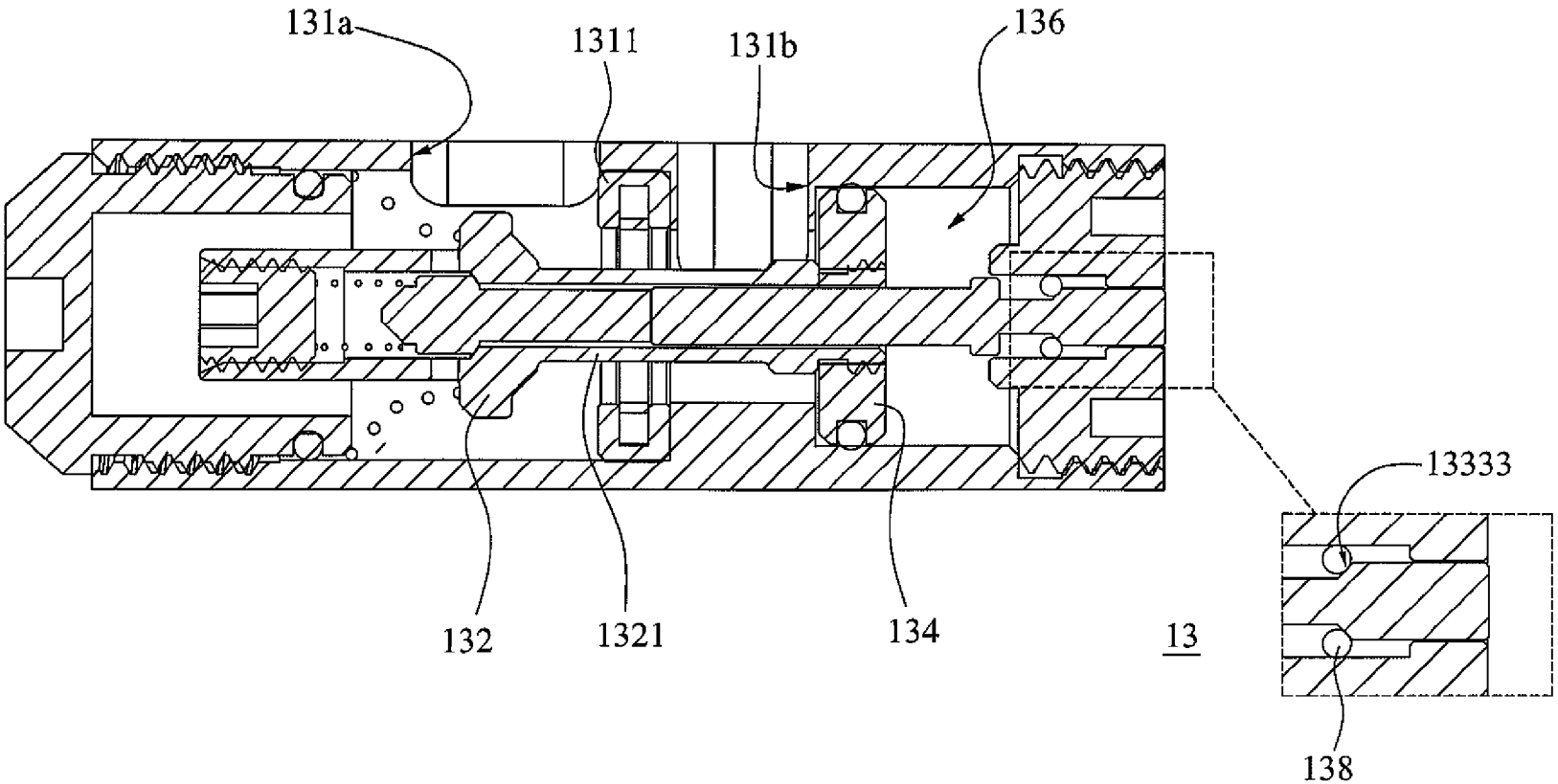

Referring to FIG. 3C, the high pressure gas flown into the third gas chamber 136 pushes the first slide element 134 forwards and drives the second duct 1321 and the first valve disc 132 to move forwards so that the first valve disc 132 is separated from the first valve seat 1311. The first valve disc 132 presses the head 1334 of the valve stem 133 again. And the high pressure gas flown through the first connection port 131*a* flows through the second connection port 131*b*, and flows into the first gas chamber 113 to push the rear push rod 112 (referring to FIG. 2B). Meanwhile, the third sealing element 138 remains on the conical surface 13333 to block gas flow between the third gas chamber 136 and the exterior.

Figure 3D:
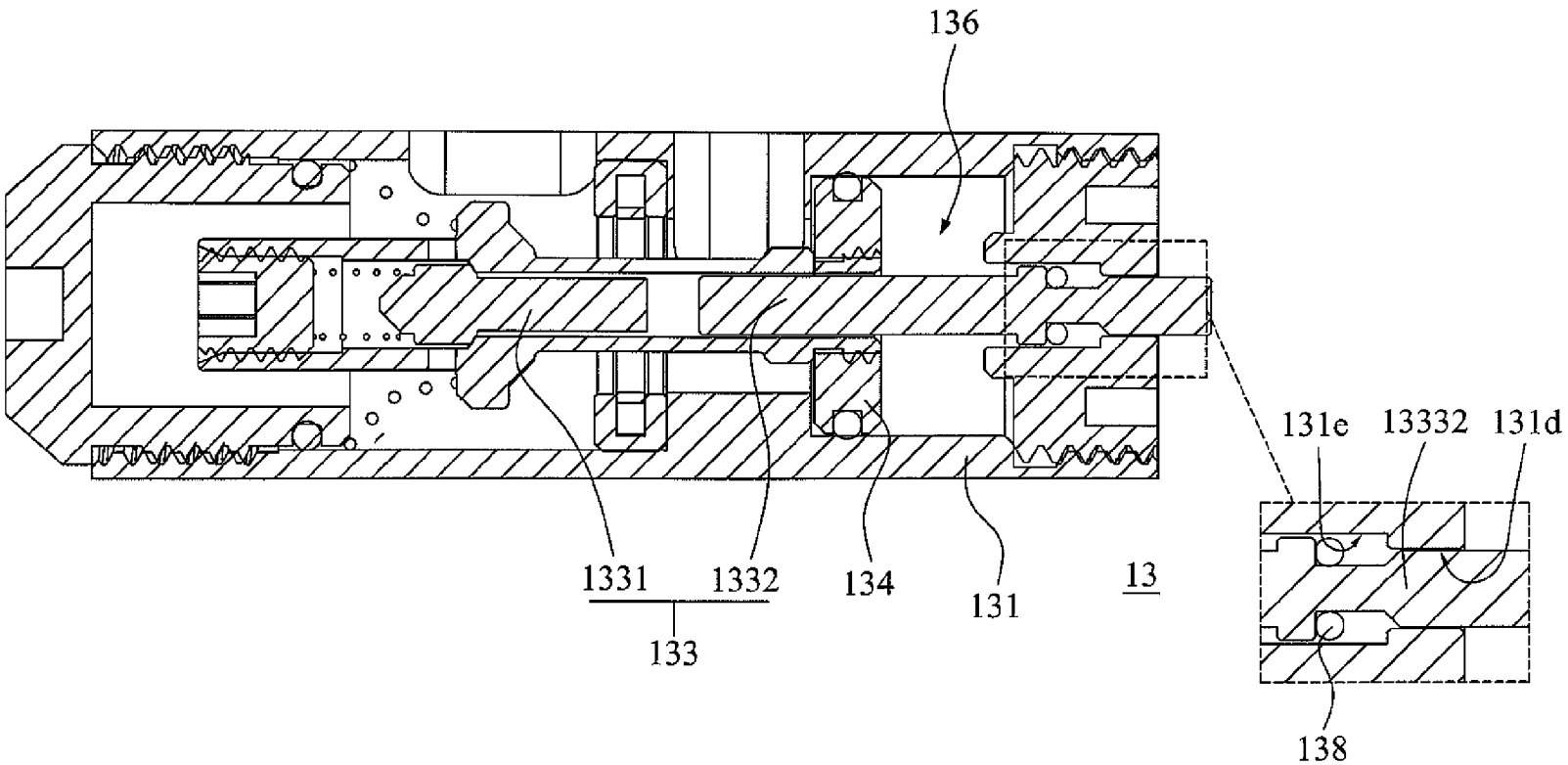

Referring to FIG. 3D, as the pressure in the third gas chamber 136 is greater than the pressure outside the valve body 131, the high pressure gas in the third gas chamber 136 pushes the rear valve stem 1332 rearwards so that the third sealing element 138 originally located on the conical surface 13333 is moved to the smaller shank 13332. The third gas chamber 136 is no longer shielded from the exterior, hence the high pressure gas flows out through the third slide flute 131*e* and the second slide flute 131*d*. After the high pressure gas has flown out from the third gas chamber 136, two sides of the first slide element 134 and two ends of the valve stem 133 receive unbalanced pressures, hence the first slide element 134 and the valve stem 133 are moved rearwards to return in the condition shown in FIG. 3A.

By means of the construction set forth above, the thrust element 122 can move the valve stem 133 of a smaller mass to trigger the high pressure gas to push the first valve 132 forwards that has a larger cross section. Thus the pneumatic toy gun 1 of the invention can provide a greater amount of gas flow through the air valve without increasing the voltage or housing space of batteries.

As a conclusion, in the pneumatic assembly of the invention, after the front push rod 114 and the rear push rod 112 are separated, the high pressure gas in the first gas chamber 113 flows instantly into the air discharge passage 1141. Hence a great instantaneous gas pressure blast force is generated to drive the bullet 2. Moreover, as the air valve 13 of the invention requires the thrust element 122 to push only the valve stem 133 of a smaller mass to trigger the high pressure gas to push the first vale 132 of a greater mass and cross section forwards, the pneumatic top gun can provide an instantaneous gas pressure blast force without the need of increasing the battery voltage.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

I claim:

1. A pneumatic toy gun, comprising a pneumatic assembly and an air valve, wherein the pneumatic assembly includes:

an air intake duct to receive high pressure gas;

a first duct which has an open end, an air outlet communicating with exterior and a detent block located inside;

a rear push rod located in the first duct to form a first gas chamber between the first duct and thereof, the first gas chamber having a first thrust surface, the first gas chamber and the air intake duct communicating with each other through control of an air valve;

a front push rod which is located in front of the rear push rod and coupled with a first sealing element on the periphery thereof, and has a recess and an air discharge passage inside communicating with the open end of the first duct, the air discharge passage having a rear end sealed by the rear push rod, the first duct and the front push rod forming a second gas chamber communicating with the air intake duct, the second gas chamber having a second thrust surface which is smaller than the first thrust surface; and a harness element to confine two sides of the first sealing element;

wherein the second gas chamber communicates with the air outlet through the recess when the front push rod is moved relative to the first sealing element such that the recess is located beneath the first sealing element and an instant pressure loss occurs while the detent block interferes with the rear push rod, wherein the air valve includes:

a valve body which has a first connection port, a second connection port and a first slide flute, the first connection port communicating with the air intake duct, the valve body having a first valve seat located inside;

a first valve disc which is connectable to the first valve seat to block communication between the first connection port and the second connection port, and has a rear end extended to form a second duct which has a tail end with a first slide element located thereon, the first slide element being in contact with the first slide flute by sliding and coupled with a second sealing element on the periphery thereof, the first sliding flute being divided by the first slide element to form a third gas chamber and a fourth gas chamber; and a valve stem which runs through the second duct and has a tail end partly exposed outside the valve body, and an outer diameter smaller than the inner diameter of the second duct, and a head having an outer diameter greater than the inner diameter of the second duct, the head pressing the first valve disc such that when the valve stem is moved forwards the head is separated from the first valve and high pressure gas flown through the first connection port flows through the second duct into the third gas chamber.

2. The pneumatic toy gun of claim 1, wherein the valve body has a second slide flute and a third slide flute, the second flute having a smaller internal diameter than the third slide flute, the tail end of the valve stem having a larger shank and a smaller shank that are connected through a conical surface, the larger shank being in contact with the second slide flute by sliding, the smaller shank having a third sealing element located thereon, the second slide flute having one end close to the third gas chamber sealed by the third sealing element.

3. The pneumatic toy gun of claim 2, wherein the second sealing element and the third sealing element are respectively an O-shape ring.

4. The pneumatic toy gun of claim 1, wherein the valve stem includes a front valve stem and a rear valve stem, the head of the valve stem being located on the front valve stem, the tail end of the valve stem being located on the rear valve stem.

5. The pneumatic toy gun of claim 1, further having a hand stock which has a trigger and a thrust element located inside, the thrust element having one end connecting to the tail end of the valve stem such that the thrust element pushes the valve stem when the trigger is actuated.

6. The pneumatic toy gun of claim 1, wherein the first sealing element is an O-shape ring.

* * * * *